US007330117B2

(12) United States Patent
Ferguson et al.

(10) Patent No.: US 7,330,117 B2
(45) Date of Patent: Feb. 12, 2008

(54) SYSTEMS AND METHODS FOR RADIO FREQUENCY TRIGGER

(75) Inventors: Alan Lewis Ferguson, Peoria, IL (US); Trent Ray Meiss, Eureka, IL (US); Brian Lane Jenkins, Washington, IL (US); Steven Wayne O'Neal, Bartonville, IL (US); Daniel Craig Wood, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 302 days.

(21) Appl. No.: 10/924,865

(22) Filed: Aug. 25, 2004

(65) Prior Publication Data

US 2006/0044146 A1 Mar. 2, 2006

(51) Int. Cl.
*G08B 13/14* (2006.01)

(52) U.S. Cl. ..... 340/572.1; 340/10.1; 340/679; 340/870.01; 340/686.6; 235/375; 700/108

(58) Field of Classification Search ..... 340/572.1
See application file for complete search history.

(56) References Cited

U.S. PATENT DOCUMENTS 4,926,331 A 5/1990 Windle et al.
5,196,846 A 3/1993 Brockelsby et al.
5,245,346 A 9/1993 Nishimura et al.
5,621,412 A 4/1997 Sharpe et al.
5,635,693 A 6/1997 Benson et al.
5,664,113 A * 9/1997 Worger et al. ..... 705/28
5,714,946 A 2/1998 Gottshall et al.
5,790,946 A 8/1998 Rotzoll
5,929,779 A 7/1999 MacLellan et al.
5,995,898 A 11/1999 Tuttle
6,006,148 A 12/1999 Strong
6,112,152 A * 8/2000 Tuttle ..... 340/5.61
6,150,948 A 11/2000 Watkins
6,329,944 B1 12/2001 Richardson et al.
6,408,232 B1 * 6/2002 Cannon et al. ..... 340/933
6,525,648 B1 2/2003 Kubler et al.
6,526,341 B1 2/2003 Bird et al.
6,593,845 B1 7/2003 Friedman et al.
6,633,769 B2 10/2003 Shoobridge
6,669,089 B2 12/2003 Cybulski et al.
6,988,034 B1 * 1/2006 Marlatt et al. ..... 701/200

(Continued)

FOREIGN PATENT DOCUMENTS

EP 1199680 4/2002

(Continued)

*Primary Examiner*—Benjamin C. Lee
*Assistant Examiner*—Eric M. Blount
(74) *Attorney, Agent, or Firm*—Finnegan, Henderson, Farabow, Garrett & Dunner

(57) ABSTRACT

Systems and methods are provided for utilizing a work machine having a radio frequency device. The system includes a radio frequency reader that transmits a radio frequency signal over a first communication channel to the radio frequency device when the work machine travels within range of the radio frequency reader. The radio frequency device generates a trigger signal in response to the radio frequency signal, and an interface control system receives the trigger signal from the radio frequency device and performs a predetermined programmed function associated with the work machine based on information included in the trigger signal.

37 Claims, 6 Drawing Sheets

U.S. PATENT DOCUMENTS

| | | | | |
|---|---|---|---|---|
| 6,990,398 | B2 * | 1/2006 | Kinugawa | 340/933 |
| 6,998,956 | B2 * | 2/2006 | Dix | 340/5.25 |
| 7,042,346 | B2 * | 5/2006 | Paulsen | 340/572.1 |
| 2003/0004624 | A1 | 1/2003 | Wilson et al. | |
| 2003/0097304 | A1 | 5/2003 | Hunt | |
| 2003/0104848 | A1 | 6/2003 | Brideglall | |
| 2003/0220711 | A1 | 11/2003 | Allen | |
| 2003/0236601 | A1 * | 12/2003 | McLeod et al. | 701/29 |
| 2005/0206503 | A1 * | 9/2005 | Corrado et al. | 340/10.5 |

FOREIGN PATENT DOCUMENTS

| | | |
|---|---|---|
| GB | 2358506 | 7/2001 |
| WO | WO 02/097738 | 12/2002 |

* cited by examiner

SYSTEMS AND METHODS FOR RADIO FREQUENCY TRIGGER

TECHNICAL FIELD

The disclosure relates generally to radio frequency communications, and more particularly to systems and methods for providing radio frequency triggering of communications within a work machine.

BACKGROUND

An important feature in modern work machines (e.g., fixed and mobile commercial machines, such as construction machines, fixed engine systems, marine-based machines, etc.) is the on-board network and associated machine control modules. An on-board network includes many different modules connected to various types of communication links. These links may be proprietary and non-proprietary, such as manufacturer-based data links and communication paths based on known industry standards (e.g., J1939, RS232, RP 1210, RS-422, RS-485, MODBUS, CAN, etc.). A machine control module may monitor and/or control one or more components of the work machine. The control module may also receive data from and transmit data to external systems.

Current conventional systems may use antennas to send and receive signals that interact with RFID tags associated with various types of equipment. The RFID tags may provide information that may be received by a computer system. One such system is disclosed in U.S. Patent Application Publication No. 2003/0097304 A1 ("the '304 application"), which discloses an automated unmanned rental system that enables the automated tracking of rental activity and equipment movement.

Each unmanned rental site has a computer system that monitors rental activity, the available inventory, and rented inventory. Based on the monitoring, the system automatically generates invoices for items rented. The computer system controls an RFID tracking system that utilizes the RFID tags on each piece of audio visual equipment in cooperation with one or more antennas. The antennas send and receive signals that interact with the RFID tags when the equipment containing the RFID tag passes through a portal. The computer system has a user interface for associating equipment rental activity with a user and a reference document. The system also includes a reporting module that automatically reports equipment movements and a security alarm module that triggers an audible alarm under defined circumstances.

Although the system described in the '304 application allows the computer system to receive information provided by the RFID tags, the '304 application does not disclose a system where information received from the RFID tags initiates the automatic transmission of data to an external system over a second communication channel.

Methods, systems, and articles of manufacture consistent with certain disclosed embodiments may solve one or more of the problems set forth above.

SUMMARY

Systems and methods are provided for utilizing a work machine having a radio frequency device. In one embodiment, the system includes a radio frequency reader that transmits a radio frequency signal over a first communication channel to the radio frequency device when the work machine travels within range of the radio frequency reader.

The radio frequency device generates a trigger signal in response to the radio frequency signal, and an interface control system receives the trigger signal from the radio frequency device and performs a predetermined programmed function associated with the work machine based on information included in the trigger signal.

In another embodiment, the system performs a process that utilizes a work machine having a radio frequency device. The process includes transmitting a radio frequency signal from a radio frequency reader over a first communication channel to a radio frequency device, when the work machine travels within a range of the radio frequency reader. The radio frequency device provides, in response to the radio frequency signal, a trigger signal to an interface control system within the work machine. The interface control system receives the trigger signal and determines and performs a predetermined programmed function based on the trigger signal.

BRIEF DESCRIPTION OF THE DRAWINGS

The accompanying drawings, which are incorporated in and constitute a part of this specification, illustrate several embodiments and together with the description, serve to explain the principles of the disclosed communication system. In the drawings.

DETAILED DESCRIPTION

Reference will now be made in detail to exemplary embodiments, which are illustrated in the accompanying drawings. Wherever possible, the same reference numbers will be used throughout the drawings to refer to the same or like parts.

Figure 1:
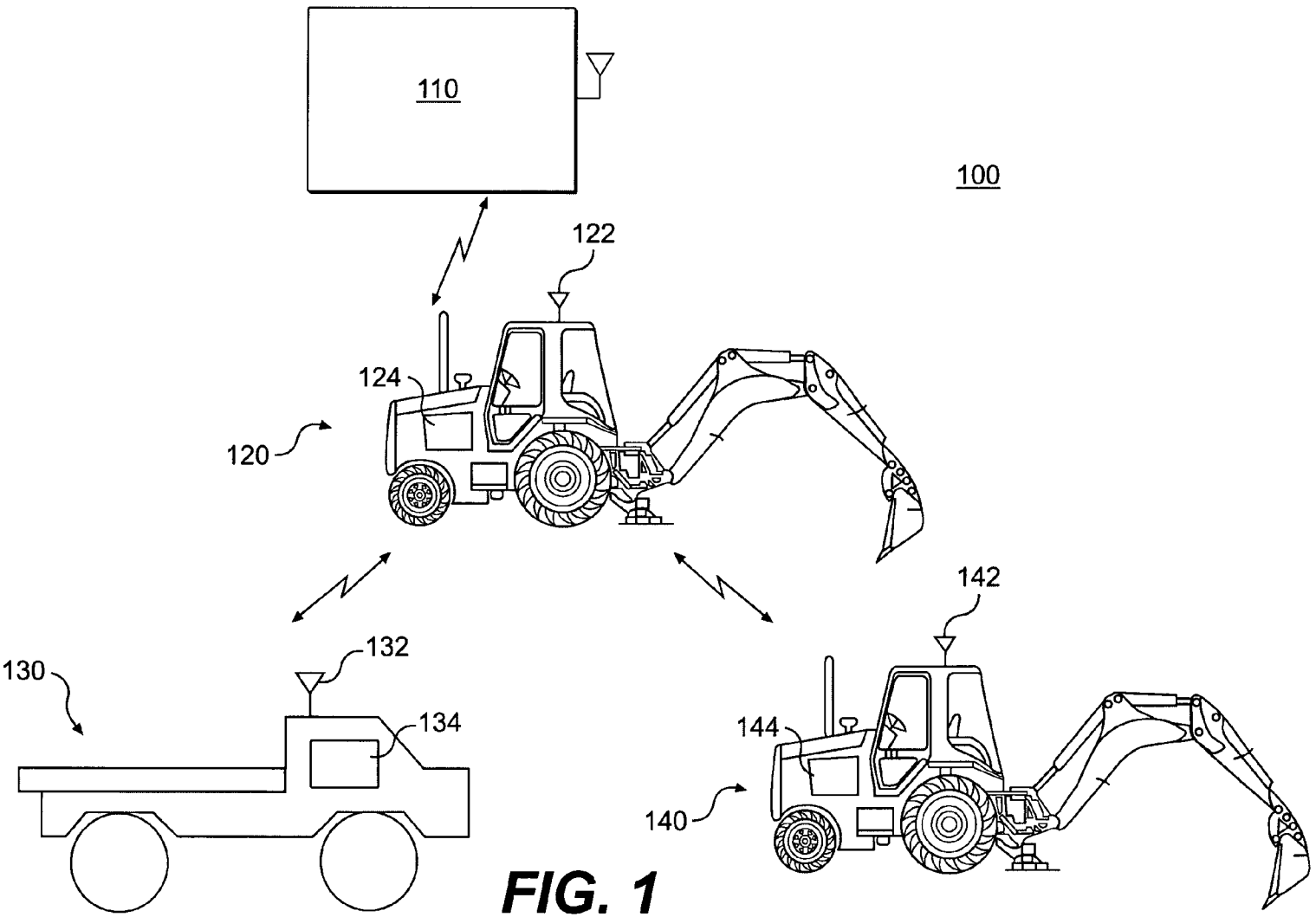
FIG. 1 illustrates a diagrammatic diagram of an exemplary work machine environment 100 consistent with certain disclosed embodiments.

FIG. 1 illustrates an exemplary work machine environment 100 in which features and principles consistent with certain disclosed embodiments may be implemented. As shown in FIG. 1, work machine environment 100 may include a remote off-board system 110 and work machines 120, 130, and 140. Each work machine 120, 130, and 140 includes a wireless communication device, such as antennae 122, 132, and 142, and an on-board system 124, 134, and 144, respectively. Although only a specific number of work machines are shown, environment 100 may include any number and types of such machines and/or off-board systems.

Work machine, as the term is used herein, refers to a fixed or mobile machine that performs some type of operation associated with a particular industry, such as mining, construction, farming, etc. and operates between or within work environments (e.g., construction site, mine site, power plants, etc.). A non-limiting example of a fixed machine includes an engine system operating in a plant or off-shore environment (e.g., off-shore drilling platform). Non-limiting examples of mobile machines include commercial machines, such as trucks, cranes, earth moving vehicles, mining vehicles, backhoes, material handling equipment, farming equipment, marine vessels, aircraft, and any type of movable machine that operates in a work environment. As shown in FIG. 1, work machines 120 and 140 are backhoe type work machines, while machine 130 is a hauler-type work machine. The types of work machine illustrated in FIG. 1 are exemplary and not intended to be limiting. It is contemplated by the disclosed embodiments that environment 100 may implement any number of different types of work machines.

An off-board system, as the term is used herein, may represent a system that is located remote from work machines 120, 130, and 140. An off-board system may be a system that connects to work machine 120 through wireline or wireless data links. Further, an off-board system may be a computer system including known computing components, such as one or more processors, software, display, and interface devices that operate collectively to perform one or more processes. Alternatively, or additionally, an off-board system may include one or more communication devices that facilitate the transmission of data to and from work machine 120. In certain embodiments, an off-board system may be another work machine remotely located from work machine 120.

Remote off-board system 110 may represent one or more computing systems associated with a business entity corresponding to work machines 120, 130, and 140, such as a manufacturer, dealer, retailer, owner, project site manager, a department of a business entity (e.g., service center, operations support center, logistics center, etc.), or any other type of entity that generates, maintains, sends, and/or receives information associated with machines 120, 130, and 140. Remote off-board system 110 may include one or more computer systems, such as a workstation, personal digital assistant, laptop, mainframe, etc. Remote off-board system 110 may include Web browser software that requests and receives data from a server when executed by a processor and displays content to a user operating the system. In one embodiment of the disclosure, remote off-board system 110 is connected to work machine 120 through a local wireless communication device. Remote off-board system 110 may also represent one or more portable, or fixed, service systems that perform diagnostics and/or service operations that include receiving and sending messages to work machine 120. For example, remote off-board system 110 may be an electronic testing device that connects to work machine through an RS-232 serial data link or through wireless communication mediums.

Wireless communication devices 122, 132, and 142 may represent one or more wireless antennae configured to send and/or receive wireless communications to and/or from remote systems, such as off-board system 110 and other work machines. Although devices 122, 132, 142 are shown being configured for wireless communications, other forms of communications are contemplated. For example, work machines 120, 130, and 140 may exchange information with remote systems using any type of wireless, wireline, and/or combination of wireless and wireline communication networks and infrastructures. As shown in FIG. 1, work machine 120 may wirelessly exchange information with work machines 130 and 140, and off-board system 110. Further, work machines 130 and 140 may exchange information with off-board system 110 and work machine 120.

Figure 2:
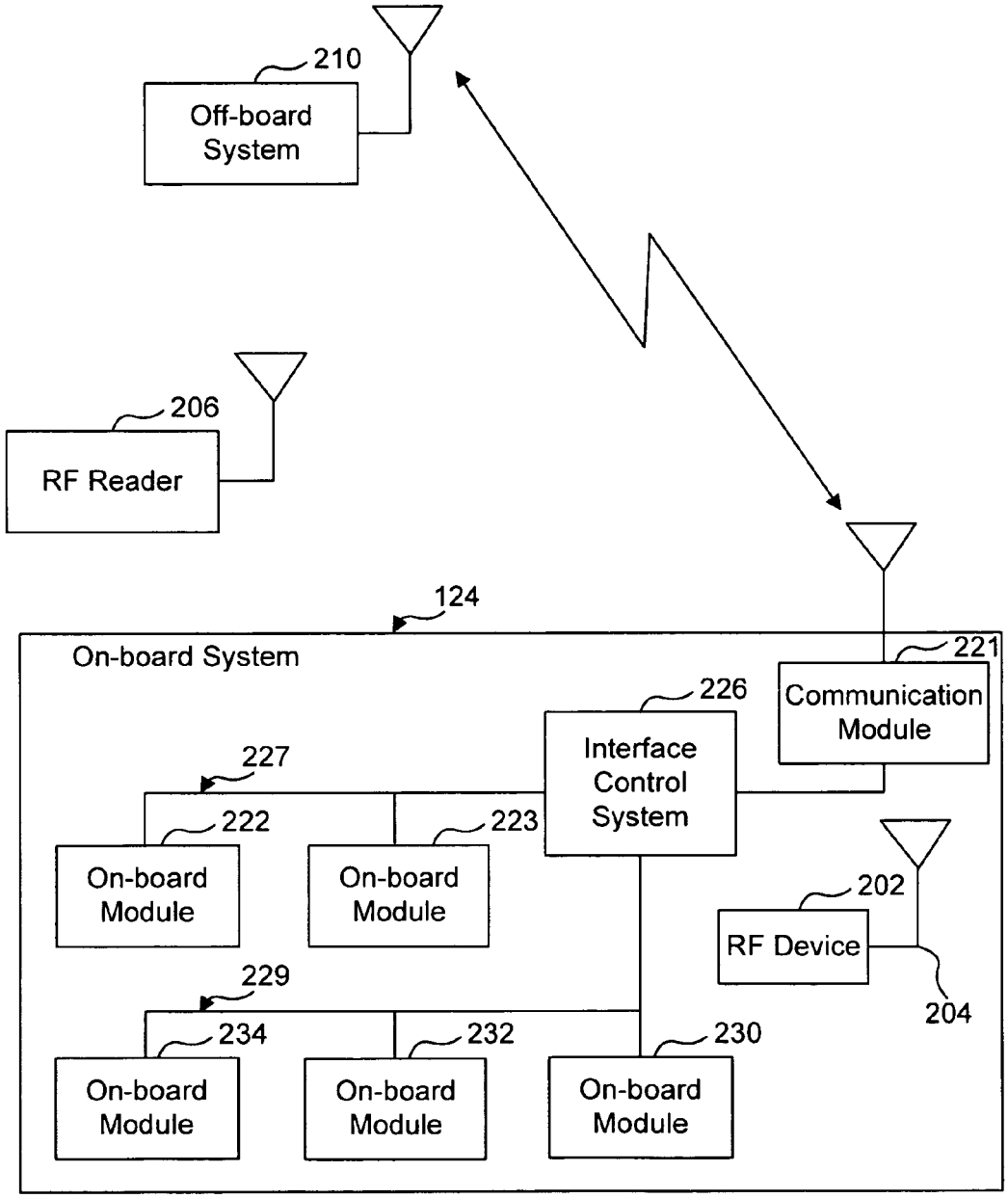
FIG. 2 illustrates a diagrammatic diagram of an on-board system consistent with certain disclosed embodiments.

On-board systems 124, 134, and 144 may represent a system of one or more on-board modules, interface systems, data links, and other types of components that perform machine processes within work machines 120, 130, and 140. FIG. 2 shows a block diagram of on-board system 124 consistent with certain disclosed embodiments. The following description of on-board system 124 is applicable to on-board systems 134 and 144.

As shown in FIG. 2, on-board system 124 may include a communication module 221, an interface control system 226, and on-board modules 222, 223, 230, 232, and 234, respectively connected to primary and secondary on-board data links 227 and 229. Although interface control system 226 is shown as a separate entity, some embodiments may allow control system 226 to be included as a functional component of one or more of the on-board modules. Further, although only a specific number of on-board control modules are shown, system 124 may include any number of such modules.

An on-board module, as the term is used herein, may represent any type of component operating in a work machine that controls or is controlled by other components or sub-components. For example, an on-board module may be an operator display device, an Engine Control Module (ECM), a power system control module, a Global Positioning System (GPS) interface device, an attachment interface that connects one or more sub-components, and any other type of device that work machine 120 may use to facilitate operations of the machine during run time or non-run time conditions (i.e., machine engine running or not running, respectively).

Communication module 221 represents one or more devices that is configured to facilitate communications between work machine 120 and an off-board system, such as remote off-board system 110. Communication module 221 may include hardware and/or software that enables the module to send and/or receive data messages through wireline or wireless communications. Communication module 221 may also include one or more wireless antennae for facilitating wireless communications with remote off-board system 110, although other off-board systems may send and receive data messages to and from communication module 221. The wireless communications may include satellite, cellular, infrared, and any other type of wireless communications that enables work machine 120 to wirelessly exchange information with an off-board system.

Modules 222 and 223 represent one or more on-board modules connected to a primary data link 227 included in work machine 120. Primary data link may represent a proprietary or non-proprietary data link, such as Society of Automotive Engineers (SAE) standard data link including Controller Area Network (CAN), J1939, etc. Primary data link 227 may be wireless or wired. For example, in one embodiment, work machine 120 may include wireless sensors that are linked together through interface control system 226. The term "primary data link" is not intended to be limiting. That is, "primary" refers to a data link for designation purposes only, and does not infer primary functionality associated with the data link or any on-board modules connected to the primary data link. However, certain embodiments may arrange on-board modules on specified data links that have different work machine importance in terms of functionality than other on-board modules.

Modules 230, 232, and 234 represent on-board modules connected to a secondary data link 229 within work machine 120. Secondary data link 229 may be a proprietary or non-proprietary data link. Further, secondary data link 229 may be wireless or wired. The term "secondary data link" is not intended to be limiting. That is, "secondary" refers to a data link for designation purposes only, and does not infer secondary functionality associated with the data link or any on-board modules connected to the secondary data link. However, certain embodiments may arrange on-board modules and interface control system 226 on specified data links that have different work machine importance in terms of functionality than other on-board modules.

On-board modules 222, 223, 230, 232, and 234 may include one or more processing devices and memory devices for storing data executed by the processing devices (all not shown). In one embodiment, on-board modules 222, 223, 230, 232, and 234 may include software that is stored in a rewritable memory device, such as a flash memory. The software may be used by a processing device to control a particular component of work machine 120, such as an engine component. In certain embodiments, the software is modifiable through commands received by the processing devices over respective data links 227 and 229.

Interface control system 226 represents an on-board interface device configured to perform functions consistent with embodiments of the work machine. Interface control system 226 may be configured with various types of hardware and software depending on its application within work machine 120. Thus, in accordance with certain embodiments, interface control system 226 may provide interface capability that facilitates the transmission of data to and from communication module 221 and on-board modules 222, 223, 230, 232, and 234. Further, interface control system 226 performs various data processing functions and maintains data for use by one or more on-board modules or off-board systems. For example, interface control system 226 may be configured to perform protocol conversions (e.g., tunneling and translations) and message routing services for on-board data links.

For clarity of explanation, FIG. 2 depicts interface control system 226 as a distinct element. However, interface control functionality may be implemented via software, hardware, and/or firmware within one or more modules (e.g., 222 and 223) on an on-board data link. Thus, interface control system 226 may, in certain embodiments, represent functionality or logic embedded within another element of work machine 120.

In one embodiment, interface control system 226 may include various computing components used to perform certain functions consistent with the requirements of that embodiment. To do so, interface control system 226 may include one or more processors and memory devices (not shown). For example, interface control system 226 may include a digital core that includes the logic and processing components used by interface control system 226 to perform interface, communications, software update functionalities, and software driver selection. In one embodiment, the digital core may include one or more processors and internal memories. The memories may represent one or more devices that temporarily store data, instructions, and executable code, or any combination thereof, used by a processor. Further, the memories may represent one or more memory devices that store data temporarily during operation of interface control system 226, such as a cache memory, register device, buffer, queuing memory device, and any type of memory device that maintains information. The internal memory used by interface control system 226 may be any type of memory device, such as flash memory, Static Random Access Memory (SRAM), and battery backed non-volatile memory devices.

In operation, the digital core may execute program code to facilitate communications between on-board modules and/or off-board systems. In one embodiment, interface control system 226 may include software that performs protocol conversion operations for converting information associated with one type of data link to another. The conversion operations may include protocol translation and tunneling features.

In one embodiment, as illustrated in FIG. 2, on-board system 124 may include a module including a Radio Frequency (RF) device 202. Although, FIG. 2 shows RF device 202 as a discrete element, one or more modules 222, 223, 230, 232, and 234, and interface control system 226 may contain a radio frequency device 202. In addition to, or in an alternate embodiment, RF device 202 may provide one or more signals directly to any of the on-board modules 222, 223, 230, 232, and 234, and/or interface control system 226.

RF device 202 may be a device that is configured to send and/or receive data based on wireless communications, such as a Radio Frequency Identification (RFID) tag device. In one embodiment, RF device 202 may include a processor (not shown) attached to an antenna 204. An RF reader 206, which may be located at off-board module 110 or at any location within or outside of a work site, may be used to scan RF device 202 once the device is within a predetermined range of RF reader 206. Based on the radio signals emitted from RF reader 206 during the scan, RF device 202 is energized and may emit a radio frequency signal transmitting information to RF reader 206. In accordance with certain disclosed embodiments, RF device 202 may be configured to provide signals or information to other elements, such as on-board components 222, 223, 230, 232, and 234, and/or interface control system 226.

For example, a work machine (e.g., work machine 120) equipped with RF device 202 may travel within range of RF reader 206 that is positioned in certain locations within a work site or business area (e.g., a rental yard that leases machines, a service location that provides services to work machines, etc.). As the work machine approaches RF reader 206, it may send a radio frequency signal to RF device 202. Upon receipt of the radio frequency signal, RF device 202 may provide a trigger signal to interface control system 226. The trigger signal may direct interface control system 226 to perform one or more programmed functions. In an additional or alternate embodiment, RF device 202 may transmit the trigger signal to one or more on-board modules 222, 223, 230 232, and 234, which directs the respective modules to perform a programmed function, such as sending information to interface control system 226. For example, interface control system 226 may be configured to send data to communication module 221 for transmission to off-board system 110 based on the received trigger signal and/or the information received from on-board modules 222, 223, 230, 232, and/or 234.

Figure 3B:
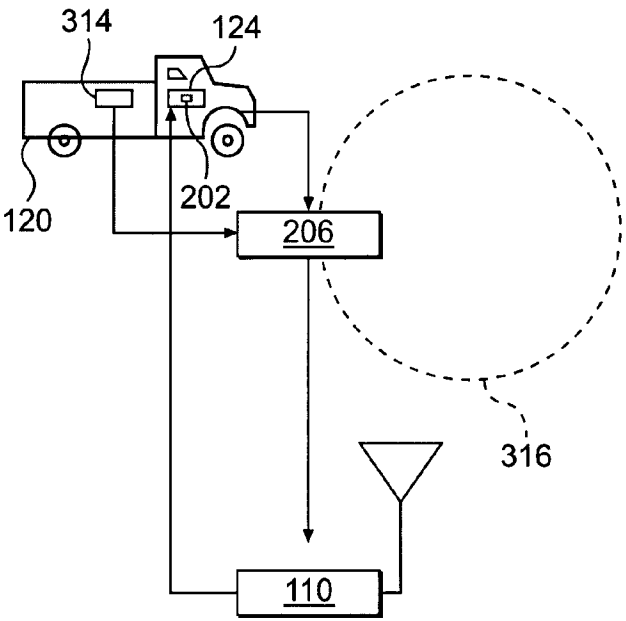
FIG. 3B illustrates a diagrammatic diagram of an exemplary system for assuring the proper assignment of work machines to operators consistent with certain disclosed embodiments.
Figure 3A:
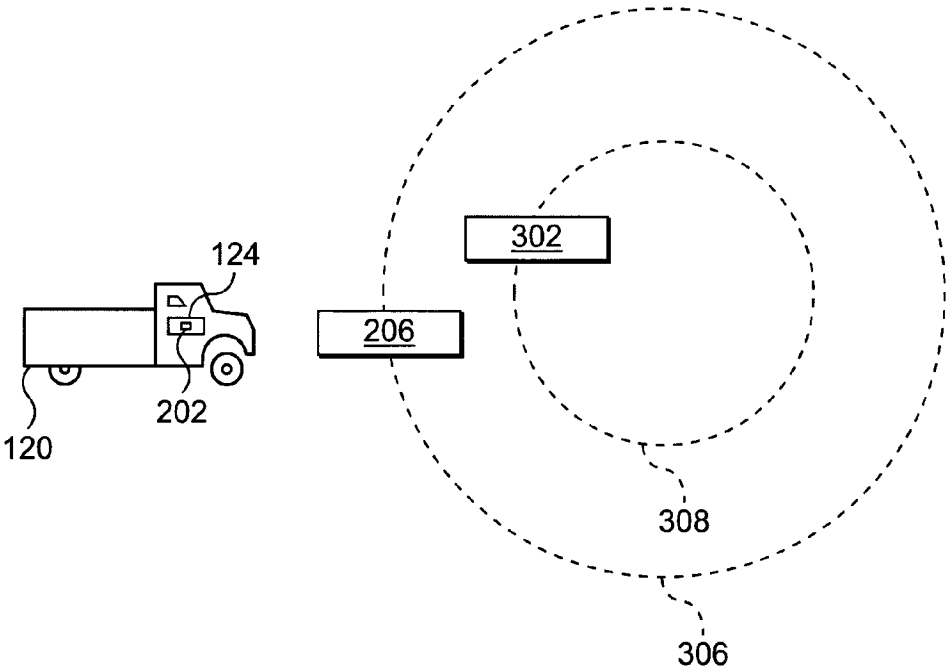
FIG. 3A illustrates a diagrammatic diagram of an exemplary system for initializing work machine functions consistent with certain disclosed embodiments.

In another embodiment, as shown in FIG. 3A, RF device 202 and multiple RF readers (e.g., 206 and 302) may be used to define overlapping zones that may be used to initiate one or more work machine related functions. For example, two zones (306 and 308) may be, respectively, defined by the radio frequency range of RF readers 206 and 302. In this configuration, one function may be triggered when radio frequency device 202 comes within range of RF reader 206, and a second function may be triggered when radio frequency device 202 comes within range of RF reader 302. For example, when work machine 120 including RF device 202 comes within range of RF reader 206 (zone 306), radio RF device 202 may send a trigger signal to interface control module 226. The trigger signal may include information corresponding to the zone that work machine 120 has entered. Based on the trigger signal, interface control module 226 may perform a first programmed function. Subsequently, when work machine 120 travels within range of the second RF reader 302 (zone 308), RF device 202 may send another trigger signal including information corresponding to zone 308. Based on this trigger signal, interface control system 226 may perform a second programmed function.

To illustrate the multi-function capabilities of the disclosed embodiments, consider the following example illustrated in FIG. 3A. When work machine 120 enters zone 306, interface control system 226 receives a trigger signal from RF device 202. Consequently, interface control system 226 may perform a first function, such as requesting information from one or more on-board modules 222, 223, 230, 232, and 234. In response to the request, on-board modules 222, 223, 230, 232, and/or 234 may perform a respective function, such as retrieving parameter and/or status data corresponding to the operations controlled or monitored by the respective on-board module. For example, on-board modules 222, 223, 230, 232, and/or 234 may monitor work machine performance data which may include fuel consumption, hours of operation, average speed, and pay load carried. This information may be sent to interface control system 226 over the appropriate on-board data link 227, 229. Interface control system 226 may queue the information in a memory device. Later, when work machine 120 travels into zone 308, interface control system 226 receives a second trigger signal from RF device 202, which directs control system 226 to perform a second function. The second function, in this example, may be to send the queued information to off-board system 110 through communication module 221. Accordingly, in the above example, information may be passed more efficiently between a work machine and an off-board system because the time for collecting information prior to transmission to an off-board system is reduced by the pre-processing functions performed while the work machine is in the first zone (i.e., zone 306). Further, memory capacity may be more efficiently used because interface control system 226 may be directed to store collected information only when in predetermined zones defined by the association between an RF reader and RF device 202.

In the aforementioned examples, the functions activated by the zones relate to the communication of data; however, the functions activated by the one or more zones may relate to any work machine function that may be activated in stages.

In an alternate embodiment, one or more RF devices may be used in conjunction with RF reader 206 to assure the proper assignment of work machines to operators. In this embodiment, as shown in FIG. 3B, a work machine (e.g., work machine 120) may travel within a predetermined zone 316 based on RF reader 206. As a result, RF device 202, which is located in work machine 120, may receive a radio frequency signal from RF reader 206 that energizes RF device 202. Based on the radio frequency signal, RF device 202 may emit a radio frequency signal that transmits a first unique identification number to RF reader 206. The identification number may be a value that is assigned to RF device 202 and/or work machine 120.

In addition, a second RF device 314 that is associated with a work machine operator, may also receive a radio frequency signal from RF reader 206 as work machine 120 enters zone 316. The radio frequency signal may direct RF device 314 to emit a radio frequency signal transmitting a second unique identification number to RF reader 206. The second identification number may be a value associated with the work machine operator and/or RF device 314.

RF reader 206 receives the first and second unique identification numbers and may verify the identification numbers. RF reader 206 may then forward the two unique identification numbers to off-board system 110. Upon receipt, off-board system 110 may perform a process that analyzes the two identification numbers according to one or more analysis rules. For instance, off-board system 110 may access a database of information associating identification numbers with work machine and/or operator identification number in order to verify whether work machine 120 is properly associated with the current operator. Based on the analysis, off-board system 110 may then provide a message to work machine 120 through communication module 221. The message may include a command or information directed to interface control system 226 and/or one or more on-board modules 222, 223, 230, 232, and 234. Based on the received command or information, interface control system 226 and/or on-board modules 222, 223, 230, 232, and 234 may perform one or more programmed functions. For example, in a situation where the current operator is not properly assigned to work machine 120, the command may direct an on-board module to alter its control functions, such as performing an engine shut down routine. Alternatively, in situations where the current operator is properly assigned to work machine 120, the message sent from off-board system 110 may change one or more parameter settings associated with one or more operations of work machine 120 based on the identified operator. For instance, the message may change a parameter limit (e.g., engine speed) limiting or extending the performance of a particular operation of work machine 120 based on a profile associated with the current identified operator.

Further, certain disclosed embodiments may allow work machines to communicate using RF device 202 and RF readers 206. For example, referring to FIG. 1, work machines 120, 130, and 140 may each be equipped with an RF reader 206 and an RF device 202. In this embodiment, work machines 120, 130, and 140 may use an input from their respective RF devices 202 to initiate communications between machines. For example, work machines 120 and 130 may approach each other while traveling in a work site. As each machine comes with range of each machine's respective RF reader 206, the RF device 202 located within each of the work machines may be directed to provide a trigger signal to the machine's interface control system 226.

Based on the received trigger signal, each interface control system 226 may perform one or more programmed functions, such as sending data to communication module 221 for transmission to the other work machine (120 or 130). This feature of the above disclosed embodiments may also include staggered zones associated with RF readers 206 that direct one work machine to perform functions before the other work machine begins to perform its respective functions. For example, work machine 120 may include an RF reader 206 that is configured with a larger transmission range than an RF reader 206 included in work machine 130. Accordingly, work machine 130 may come within range of work machine 120's RF reader 206 before the converse occurs (i.e., work machine 120 entering the range of RF reader 206 of work machine 130). Accordingly, work machine 130 may be directed to perform a function before work machine 120, such as sending information to work machine 120 based on a trigger signal sent from the RF device 202 located within work machine 130.

Figure 4:
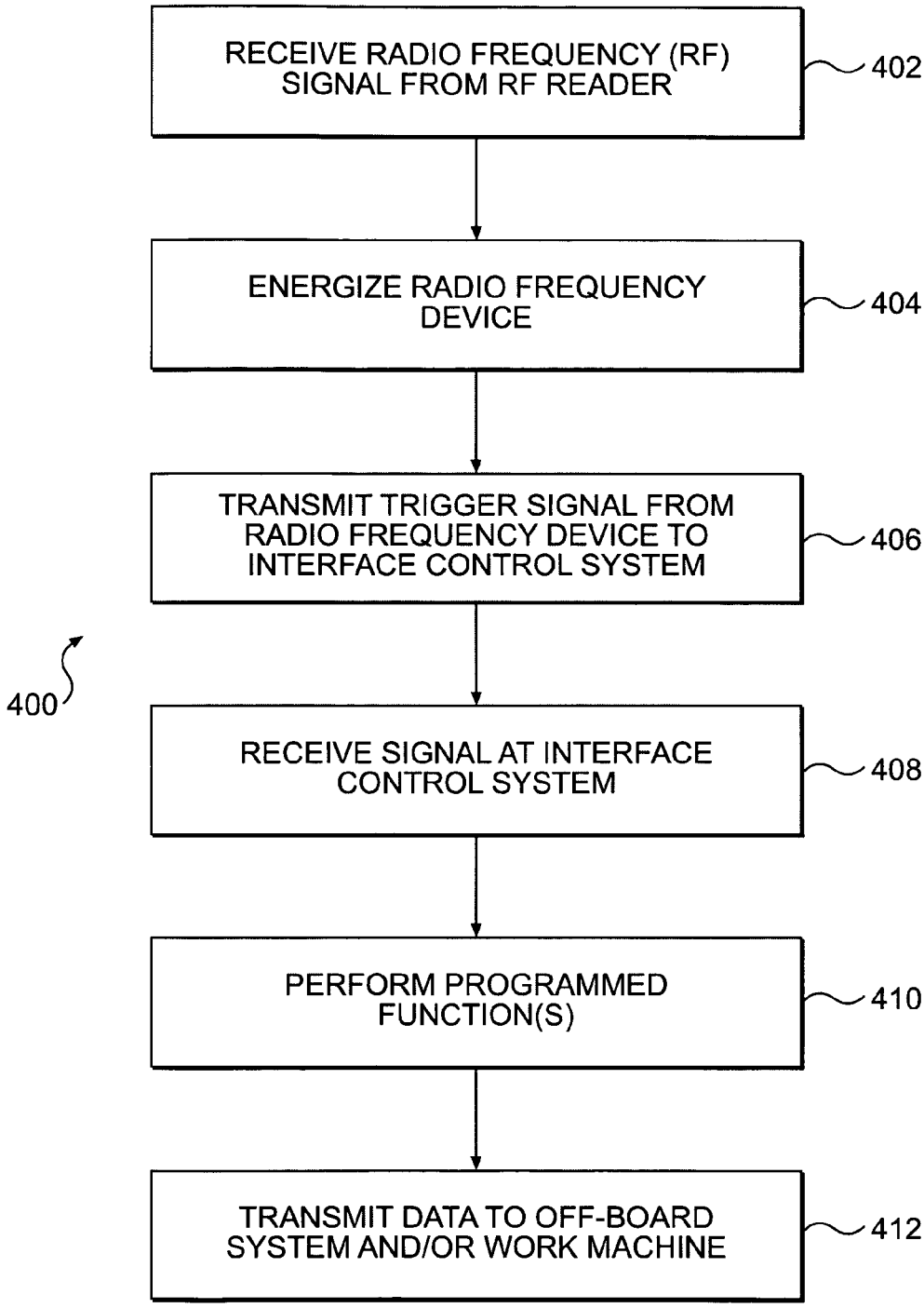
FIG. 4 illustrates a flow chart of an exemplary radio frequency trigger process consistent with certain disclosed embodiments.

As explained, certain disclosed embodiments enable one or more work machines to perform programmed functions based on a trigger signal provided by an energized RF device 202. FIG. 4 shows a flowchart of an exemplary RF trigger process 400 consistent with certain disclosed embodiments. In one embodiment, trigger process 400 may start based on an RF device 202 located within a work machine (e.g., work machine 120) receiving an RF signal from RF reader 206. (Step 402). Based on the received RF signal, RF device 202 is energized (Step 404). As a result, RF device 202 generates and transmits a trigger signal to interface control system 226. (Step 406). As explained, the trigger signal may include identification information or any other type of data that RF device 202 is capable of providing based on its configuration.

Once the trigger signal is received at interface control system 226 (Step 408), interface control system 226 performs one or more programmed functions based on the information included in the trigger signal (Step 410). In one embodiment, the programmed function performed by interface control system 226 may include providing information to off-board system 110 and/or another work machine (Step 412). For instance, interface control module 226 may collect or receive data from on-board modules 222, 223, 230, 232, and 234, store the received data, and send the data to off-board system 110 via communication module 221. Additionally, interface control system 226 may perform a programmed process that generates data that is sent to off-board system 110 and/or another work machine.

Figure 5:
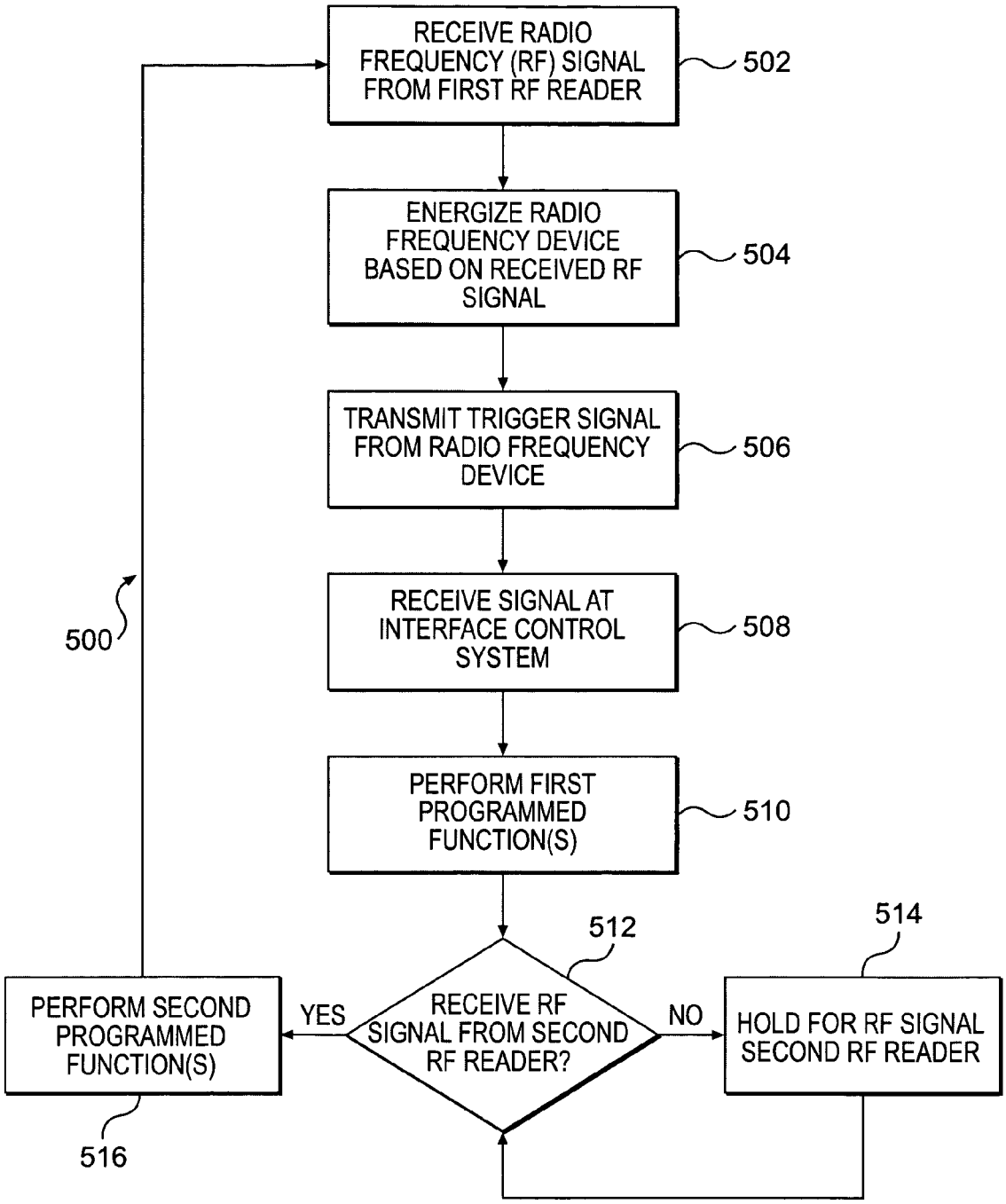
FIG. 5 illustrates a flow chart of an exemplary multi-stage initialization process consistent with certain disclosed embodiments.

As explained, the disclosed embodiments may allow a work machine to perform one or more programmed functions based on a layered configuration of RF readers 206. FIG. 5 shows a flowchart of an exemplary multi-stage initialization process 500 consistent with these embodiments. To better describe process 500, reference is made to FIG. 3A. Initially, work machine 120 may travel in a direction that positions machine 120 within the range of a first RF reader, such as zone 306 and RF reader 206. Accordingly, RF device 202 receives an RF signal from RF reader 206 (Step 502). Based on the received RF signal, RF device 202 is energized (Step 504) and a first trigger signal is transmitted to interface control system 226 (Step 506). The trigger signal may include identification information associated with the RF reader that energized RF device 202, such as RF reader 206. Once the initiation signal is received at interface control system 226 (Step 508), interface control system 226 may perform one or more first programmed functions based on information included in the first trigger signal (Step 510).

In one embodiment, interface control system 226 may include a data structure stored in memory that maps one or more functions to the identification information of a particular RF reader. Thus, by analyzing the identification information associated with RF reader 206, interface control system 226 may be programmed to perform selective functions based upon the zone work machine 120 is located. For example, interface control system 226 may be programmed to recognize identification information associated with RF reader 206 and perform respective functions based on the recognition, such as request and collect information from one more on-board modules 222, 223, 230, 232, and 234. Alternatively, or additionally, interface control system 226 may be programmed to limit or expand the functionality of work machine 120 based on the zone that work machine 120 is operating. For instance, work machine 120 may be configured to adjust parameter threshold values that control the operation of components of work machine 120, such as different engine speeds, Power Take Off (PTO) capabilities, etc.

Work machine 120 may continue to travel passing into zone 308 and within range of second RF reader 302. Consequently, RF device 202 receives a signal from RF reader 302 (Step 512; YES) and generates a second trigger signal. Interface control system 226 analyzes the RF reader identification information included in the trigger signal to identify and perform one or more appropriate second programmed functions (Step 516). The second programmed functions may include similar or different functions than the first programmed functions performed when work machine 120 entered zone 306. For example, interface control system 226 may send information previously collected by on-board modules 222, 223, 230, 232, and/or 234 to off-board system 110 or another work machine. Further, interface control system 226 may perform a process that adjusts the operations of work machine 120 through on-board modules 222, 223, 230, 232, and 234. Still further, work machine 120 may receive information from off-board system 110 while in zone 308 and perform selected functions based on the received information. Once the second functions are performed, the multi-stage initialization process 500 may continue at Step 502, waiting for the receipt of another RF signal from another RF reader.

Returning back to Step 512, if work machine 120 does not receive an RF signal from a second RF reader (Step 512; NO), the multi-stage initialization process 500 may be placed in a hold state (Step 514) while work machine 120 continues to travel or perform operations within the first zone (i.e., zone 306) until such a signal is received by the second RF reader (Step 512; YES).

In other embodiments, interface control system 226 may be configured to prevent certain programmed functions from being performed when work machine 120 passes into determined zones in selected sequences. For example, consider an environment where interface control system 226 is programmed to collect parameter values from an on-board module when entering zone 306 and is further programmed to transmit the collected values to off-board system 110 when in zone 308. Interface control system 226 may be configured to track the sequence of the RF readers that have been encountered while traveling. Thus, interface control system 226 may analyze the RF reader sequence list prior to performing a programmed function based on an identified RF reader. Based on the review of the sequence list, interface control system 226 may prevent the programmed function from being performed. Thus, in the above example, if work machine 120 is traveling from zone 308 to zone 306, there may be no need to collect parameter values from the on-board module because they may be only reported to off-board system 110 when work machine 120 is within zone 308. Accordingly, interface control system 226 may be prevented from performing the collecting function based on the RF reader sequence of RF reader 308 to RF reader 306. The above examples are not intended to be limiting, and other sequences and associated functionalities may be analyzed and considered by work machine 120 prior to determining the type of programmed function to perform.

Figure 6:
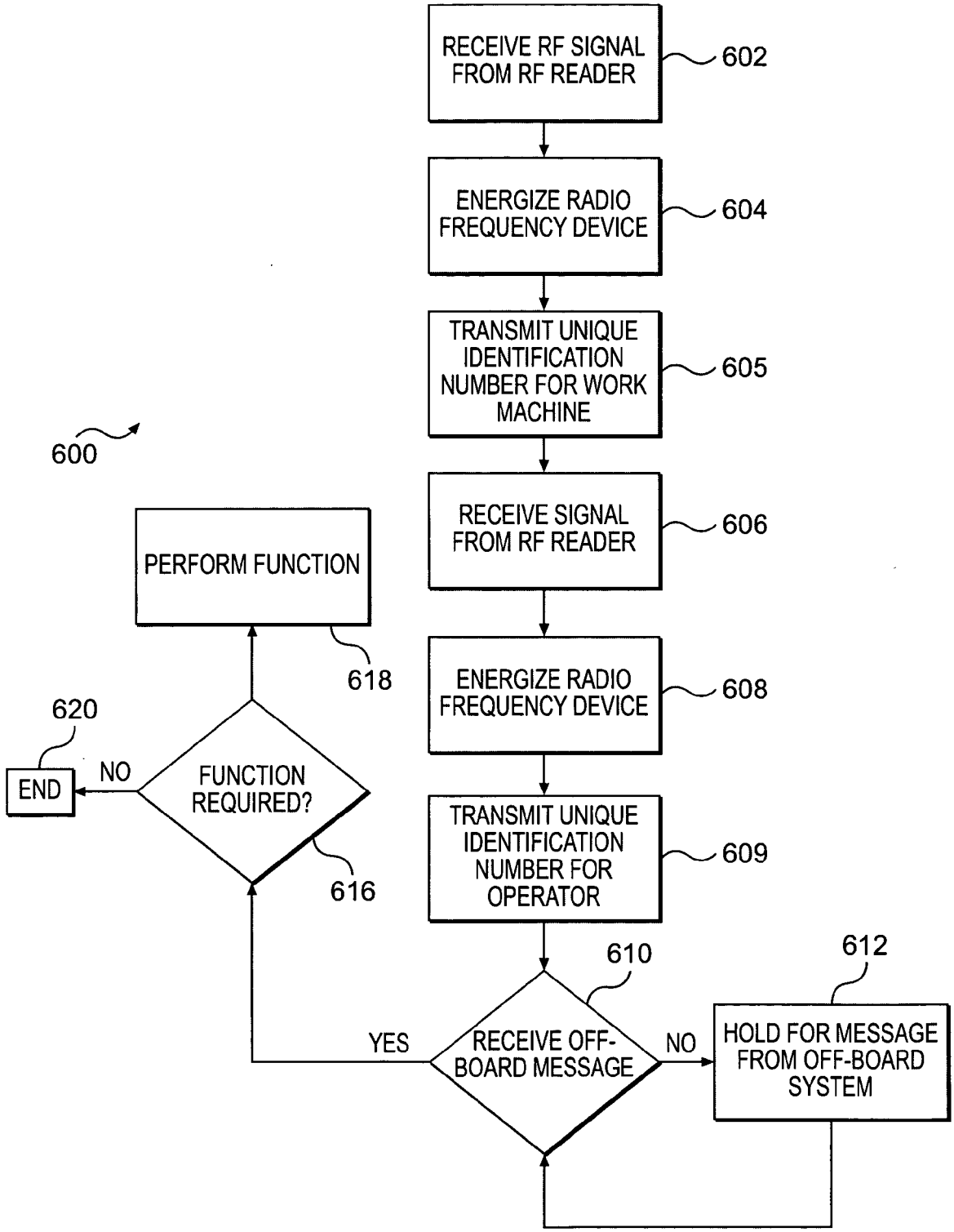
FIG. 6 illustrates a flow chart of an exemplary work machine assignment process consistent with certain disclosed embodiments.

In addition to providing multiple function capabilities using a multiple RF reader arrangement, certain disclosed embodiments enable work machines and operators to be assigned to certain functionalities and zones corresponding to one or more RF reader. FIG. 6 shows a flowchart of an exemplary work machine assignment process 600 consistent with certain disclosed embodiments. For illustrative purposes, the work machine assignment process 600 is described with reference to FIG. 3B. Process 600 may begin when a work machine (e.g., work machine 120) travels within the zone of a positioned RF reader, such as zone 316 and RF reader 206. Accordingly, RF reader 206 provides an RF signal to RF device 202 (Step 602). Based on the received RF signal, RF device 202 may be energized (Step 604), and in turn, generates and sends a RF device signal including a unique identification number associated with work machine 120 (Step 605). The RF device signal is then received at RF reader 206 (Step 606).

At the same or a different time, RF reader 206 may also provide an RF signal to RF device 314, which may be an RFID tag held by an operator of work machine 120 or is positioned within work machine 120 when the operator is running work machine 120. The RF signal energizes RF device 314 (Step 608), which directs RF device 314 to generate and send a second RF device signal including a unique identification number associated with the operator (Step 609). The second RF device signal is received by RF reader 206.

RF reader 206 may be configured to forward the received RF device signals to a processing device for subsequent analysis, such as off-board system 110. For example, off-board system 110 may analyze the unique identification numbers included in the RF device signals against a stored map of identification numbers and functionalities. For instance, off-board system 110 may maintain a data structure including a list of work machine identification numbers and corresponding operator identification numbers associated with operators authorized to operate that particular work machine. Accordingly, work machine 110 may determine whether the operator of work machine 120 is authorized to operate that machine. Other types of analysis are contemplated. For example, the data structure may include functionality listings corresponding to certain types of work machines within zone 316 and the types of operations that are authorized within zone 316 by the type of work machine identified by the respective unique identification numbers.

Based on the analysis, off-board system 110 may generate a message include data, commands, or other information for transmission to work machine 120. Off-board system 110 sends the message, which may be received by work machine 120 (Step 610). If no message is received by work machine 120 (Step 610; NO), the work machine assignment process 600 is placed in a hold state until the off-board message is received (Step 612). On the other hand, if the message is received (Step 610; YES), interface control system 226 may determine whether a particular function is to be performed based on the information included in the off-board system message (Step 616). If no function is required (Step 616; NO), process 600 ends (Step 620). If, however, interface control system 226 determines that a function is required based on the information in the off-board system message (Step 616; YES), the function is performed (Step 618).

The types of functions that may be performed by interface control system 226 may include processes performed by on-board modules 222, 223, 230, 232, and 234. Further, the functions performed may differ based on the information included in the off-board system message. For example, in the event the operator is not appropriately associated with work machine 120, interface control system 226 may be programmed to direct one or more on-board modules 222, 223, 230, 232, and 234 to adjust the operations of respective work machine components, such as performing an engine shut down, adjusting parameter thresholds that expand or limit the functionality of one or more operations of work machine 120, etc. Additionally, interface control system 226 may generate and provide warning messages to the operator indicating an unauthorized relationship between the operator and work machine 120 and/or zone 316.

Thus, using the associations between identifiers of work machines and operators, certain disclosed embodiments may control the functions of a work machine through the use of RF or similar wireless devices.

In another embodiment, on-board system 124 may be configured to allow RF device 202 to activate communication device 221. For example, in certain circumstances, communication device 221 may be configured to operate in a "normal" or a "sleep" mode. During "sleep" mode, communication device 221 may draw less power from work machine 120 than when device 221 operates in "normal" mode. During operations, work machine 120 may travel within range of an RF reader device (e.g., RF reader 206). Upon activation by the RF reader device, RF device 202 may generate a wake up trigger signal that is sent to communication device 221. Upon receiving the wake up trigger signal, communication device 221 may enter "normal" mode of operation, thus enabling interface control system 226 to send and/or receive information to/from off-board system 210 or other remote work machines (e.g., work machine 130). Accordingly, by implementing this embodiment, interface control system 124 may conserve power by allowing communication device 221 to operate in low power modes (i.e., "sleep" mode) until activated by RF device 202.

INDUSTRIAL APPLICABILITY

Methods and systems consistent with exemplary disclosed embodiments use RF devices to trigger one or more functions to be performed by an interface control system of a work machine. These functions may include sending information to an off-board system or performing selected processes based on the type of RF reader that energized the RF device within the work machine. In another embodiment, the methods and system also provide multi-stage initialization of work machine functions using a multi-layer implementation of RF readers. For example, when the RF device is within the range of a first RF reader, work machine 120 may perform a first function. Further, when the RF device is within the range of a second RF reader, work machine 120 may perform a second function.

Also, the methods and systems may provide one or more RF devices that may be used in conjunction with an RF reader to analyze the assignment of work machines to operators and or functions performed within a predetermined area. For example, multiple RF devices may be employed that respectively associate with a work machine and an operator of the machine. The RF devices provide unique identification numbers corresponding to the work machine and operator to an RF reader. The RF reader in turn forwards the two unique identification numbers to an off-board system for analysis (e.g., verify an association of the operator to the work machine). Based on the analysis, the off-board system may generate and provide a message to an interface control system of the work machine. The interface control system may perform one or more programmed functions based on information included in the received message. For instance, interface control system may direct on-board control modules to adjust operations of the work machine, or may provide a warning message indicating that an inappropriate operator is associated with the work machine.

In another embodiment, in addition to information reporting tasks, work machines that are configured in a multi-stage RF reader environment may perform security or safety operations. For example, referring to FIG. 3A, consider a situation where work machine 120 is designated as a work machine that is not authorized to enter a particular geographical area associated with zone 308. Accordingly, as work machine passes into zone 306, RF reader 206 may energize RF device 202, which in turn provides a trigger signal to interface control system 226. In a security or safety application, interface control system 226 may determine through an analysis of the identification information associated with RF reader 206 that a warning process is to be performed. Consequently, work machine 120 may provide a warning to the operator of work machine 120 indicating that the machine is traveling in a direction toward an unauthorized geographical area associated with zone 308. The unauthorized area may be one that is deemed unsafe for operations of work machine 120 or may be an area that work machine 120 and/or the operator of work machine 120 is unauthorized to enter based on security policies. Additionally, or alternatively, interface control system 226 may generate a warning message that is sent to off-board system 110 and/or another work machine. The warning may give the operator time to stop or redirect work machine 120 away from zone 308.

Upon entering zone 308, RF device 202 may receive a signal from RF reader 302. As a result, a second trigger signal is sent to interface control system 226 from RF device 202 that is analyzed by interface control system 226. Based on this subsequent analysis, interface control system 226 may perform one or more safety or secure functions that affect the operation of work machine 120, such as shutting down the engine of machine 120, reducing certain capabilities, providing higher level security or safety messages, etc. Accordingly, work machine 120 may be prevented or hindered from entering restricted or unsafe geographical areas based on programmed functions in interface control system 226 and their association with RF readers 206 and 302. Although the above examples are described with respect to a two-stage RF reader configuration, the disclosed embodiments may be performed with any number of stages of RF readers configured throughout determined geographical areas.

Also, certain disclosed embodiments may be applied to various applications, such as in environments where work machines are leased from a business entity hosting a rental yard with RF readers positioned in predetermined locations. In this environment, a leased machine that is returned to the rental yard may be directed to report status information based on a trigger signal initiated from a RF device energized by the RF readers. The status information may include engine hours, fuel levels, operation history data, and any other type of information that may be logged by a work machine while the machine was being used in the field. Other types of environments equally apply. For instance, instead of a rental yard, an RF device implemented work machine may provide operational data to a service station when the machine enters into a zone associated with the station's RF reader. Thus, a technician may receive a fault and/or operational history report at a computer system prior to the work machine being placed in a service area. Similar applications also include reporting fuel levels to a fuel service area, where a fuel service technician may receive information associated with an amount of fuel to dispense to a given work machine as it enters the fuel service area.

Additionally, certain disclosed embodiments may allow a work machine to send service request messages to mobile service units. For example, referring to FIG. 3, work machine 120 may enter within zone 306 covered by RF reader 206. In certain embodiments, RF reader device 206 may be implemented within another work machine that provides service to other work machines, such as work machine 120. For instance, RF reader 206 may be implemented within a work machine that provides service elements (e.g., fuel, fluids, maintenance tasks, supplies, etc.). Accordingly, when work machine 120 travels within range of RF reader 206, or the work machine implemented with RF reader 206 travels within range of work machine 120, RF device 202 may send a trigger signal indicating that a service work machine is within a predetermined range. In response, interface control system 226 may initiate a message that is transmitted through communication device 221 requesting a particular service, such as additional fuel. Alternatively, or additionally, when work machine 120 is within range of RF reader 206 (either by the traveling of work machine 120 or the service work machine), the service work machine may send a message to work machine 120 indicating its availability of service elements. In response to the service work machine's message, interface control system 226, or an operator of work machine 120, may direct a message to the service work machine requesting service elements.

In other embodiments, the processes described above in connection with FIGS. 4-6 are not intended to be mutually exclusive. That is, certain processes may be performed in connection with other processes to allow the disclosed embodiments to control work machine operations. For instance, the multi-stage initialization process 500 may be implemented with a work machine association process 600 in environments having multiple RF readers with corresponding zones and RF devices providing unique identification numbers to the RF readers. Other combinations of processes and configurations are contemplated and may be implemented.

Further, although disclosed embodiments have been described with an RF device that provides information in a trigger signal sent to interface control system 226 when energized by an RF reader, the trigger signal may be configured as an initialization signal. That is, interface control system 226 may be configured to receive as an initialization signal, the trigger signal from RF device 202, and based on the initialization signal, perform predetermined programmed functions.

Other embodiments, features, aspects, and principles of the disclosed exemplary systems may be implemented in various environments and are not limited to work site environment. For example, a work machine with an interface control system may perform the functions described herein in other environments, such as mobile environments between job sites, geographic locations, and settings. Further, the processes disclosed herein are not inherently related to any particular system and may be implemented by a suitable combination of electrical-based components. Embodiments other than those expressly described herein will be apparent to those skilled in the art from consideration of the specification and practice of the disclosed systems. It is intended that the specification and examples be considered as exemplary only, with the true scope of the disclosed embodiments being indicated by the following claims.

What is claimed is:

1. A system including a machine having a radio frequency device, comprising:

a radio frequency reader that transmits a radio frequency signal over a first external communication channel to the radio frequency device when the machine travels within range of the radio frequency reader, wherein the radio frequency device generates a trigger signal in response to the radio frequency signal; and an interface control system that receives the trigger signal from the radio frequency device and performs a predetermined programmed function associated with the machine based on information included in the trigger signal, wherein the predetermined programmed function includes collecting performance data from at least one on-board control module and sending the collected data over a second external communication channel different from the first external communication channel.

2. The system of claim 1, wherein the machine performance data includes at least one of fuel consumption, hours of operation, average speed, and pay load carried.

3. The system of claim 1, wherein the second external communication channel is at least one of a wireless or wireline communication channel.

4. The system of claim 1, wherein sending the performance data over the second external communication channel includes:

sending the performance data over the second external communication channel to an external computing system.

5. The system of claim 4, wherein the external computing system is at least associated with one of a machine service station, a rental yard, a fuel service station, and another machine.

6. The system of claim 4, wherein the external computing system is an on-board system of a second machine.

7. The system of claim 1, wherein the predetermined programmed function includes at least one of sending machine operation data to an off-board system, adjusting operations of the machine, and collecting information from an on-board control module within the machine.

8. The system of claim 1, wherein the interface control system analyzes identification information included in the trigger signal to determine the predetermined programmed function, wherein the identification information is associated with the radio frequency reader.

9. The system of claim 8, wherein the interface control system analyzes a map of programmed functions against the identification information to determine the predetermined programmed function to perform.

10. The system of claim 1, further including a second radio frequency reader that transmits a second radio frequency signal to the radio frequency device when the machine travels within range of the second radio frequency reader, wherein the radio frequency device generates a second trigger signal in response to the second radio frequency signal; and the interface control system receives the second trigger signal from the radio frequency device and performs a second predetermined programmed function associated with the machine based on information included in the second trigger signal.

11. The system of claim 10, wherein, prior to performing any of the predetermined program functions, the interface control system analyzes a radio frequency reader sequence list to determine whether the sequence of radio frequency readers encountered by the machine during travel authorizes the performance of any one of the predetermined program functions.

12. The system of claim 1, wherein the machine includes a second radio frequency device, and wherein the radio frequency device provides to the radio frequency reader a first unique identification number associated with the machine and the second radio frequency device provides to the radio frequency reader a second unique identification number associated with an operator of the machine.

13. The system of claim 12, wherein the radio frequency reader provides the unique identification numbers to an off-board system for off-board analysis to determine whether an association between the operator and the machine is authorized.

14. The system of claim 13, wherein the off-board system provides a message to the machine based on the off-board analysis, and the interface control system performs a second programmed function based on the received message.

15. The system of claim 14, wherein the second programmed function includes adjusting operations of the machine.

16. A method performed in an environment including a machine having a radio frequency device, the method comprising:

transmitting a radio frequency signal from a radio frequency reader over a first external communication channel to the radio frequency device when the machine travels within a range of the radio frequency reader;

providing, by the radio frequency device in response to the radio frequency signal, a trigger signal to an interface control system within the machine;

determining, by the interface control system, a predetermined programmed function to perform based on the trigger signal; and performing the predetermined programmed function at the machine by collecting performance data from at least one on-board control module and sending the collected data over a second external communication channel different from the first external communication channel.

17. The method of claim 16, wherein collecting the performance data includes collecting at least one of fuel consumption, hours of operation, average speed, and pay load carried.

18. The method of claim 16, wherein sending performance data over the second external communication channel includes using at least one of a wireless or wireline communication channel.

19. The method of claim 16, wherein sending the performance data over the second external communication channel includes:

sending the performance data over the second external communication channel to an external computing system.

20. The method of claim 19, further including associating the external computing system with at least one of a machine service station, a rental yard, and a fuel service station.

21. The system of claim 19, wherein sending the performance data to the external computing system includes sending the performance data to an on-board system of a second machine.

22. The method of claim 16, wherein performing the predetermined programmed function includes at least one of sending machine operation data to an off-board system, adjusting operations of the machine, and collecting information from an on-board control module within the machine.

23. The method of claim 16, further including analyzing identification information included in the trigger signal with the interface control system to determine the predetermined programmed function, wherein the identification information is associated with the radio frequency reader.

24. The method of claim 23, wherein analyzing the identification information includes analyzing a map of programmed functions against the identification information to determine the predetermined programmed function to perform.

25. The method of claim 16, further including transmitting a second radio frequency signal from a second radio frequency reader to the radio frequency device when the machine travels within range of the second radio frequency reader, wherein the radio frequency device generates a second trigger signal in response to the second radio frequency signal; and receiving the second trigger signal with the interface control system from the radio frequency device and performing a second predetermined programmed function associated with the machine based on information included in the second trigger signal.

26. The method of claim 25, further including analyzing a radio frequency reader sequence list, prior to performing any of the predetermined program functions, to determine whether the sequence of radio frequency readers encountered by the machine during travel authorizes the performance of any one of the predetermined program functions.

27. The method of claim 16, further including providing the radio frequency reader with a first unique identification number associated with the machine from the radio frequency device, and providing the radio frequency reader with a second unique identification number associated with an operator of the machine from a second radio frequency device.

28. The method of claim 27, further including providing the unique identification numbers from the radio frequency reader to an off-board system for off-board analysis to determine whether an association between the operator and the machine is authorized.

29. The method of claim 28, further including providing a message to the machine based on the off-board analysis, and performing a second programmed function with the interface control system based on the received message.

30. The method of claim 29, wherein performing the second programmed function includes adjusting operations of the machine.

31. A computer-readable media stored in a machine having computer executable instructions for performing steps comprising:

receiving a trigger signal from a radio frequency device in response to a radio frequency signal received from a radio frequency reader over a first external communication channel;

determining a predetermined programmed function to perform based on the trigger signal; and performing the predetermined programmed function at the machine, wherein performing the predetermined programmed function includes collecting performance data from at least one on-board control module and sending the collected data over a second external communication channel different from the first external communication channel.

32. The computer-readable media of claim 31, wherein collecting the performance data includes collecting at least one of fuel consumption, hours of operation, average speed, and pay load carried.

33. The computer-readable media of claim 31, wherein performing the predetermined programmed function includes at least one of sending machine operation data to an off-board system, adjusting operations of the machine, and collecting information from an on-board control module within the machine.

34. The computer-readable media of claim 31, further including instructions for analyzing identification information included in the trigger signal to determine the predetermined programmed function.

35. The computer-readable media of claim 34, wherein analyzing the identification information includes analyzing a map of programmed functions against the identification information to determine the predetermined programmed function to perform.

36. The computer-readable media of claim 31, further including instructions to receive a second trigger signal from the radio frequency device in response to a second radio frequency signal transmitted from a second radio frequency reader when the machine travels within range of the second radio frequency reader; and performing a second predetermined programmed function associated with the machine based on information included in the second trigger signal.

37. The computer-readable media of claim 36, further including instructions to analyze a radio frequency reader sequence list, prior to performing any of the predetermined program functions, to determine whether the sequence of radio frequency readers encountered by the machine during travel authorizes the performance of any one of the predetermined program functions.

* * * * *